US012305464B1

(12) United States Patent
Bakhshwin et al.

(10) Patent No.: US 12,305,464 B1
(45) Date of Patent: May 20, 2025

(54) WELL CELLAR WITH CLOSED CONTOUR STRUCTURED WALL

(71) Applicant: Saudi Arabian Oil Company, Dhahran (SA)

(72) Inventors: Abdullah Bakhshwin, Dhahran (SA); Anwar Parvez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/581,201

(22) Filed: Feb. 19, 2024

(51) Int. Cl.
*E21B 33/03* (2006.01)

(52) U.S. Cl.
CPC ..... *E21B 33/03* (2013.01)

(58) Field of Classification Search
CPC ..... E21B 33/03
See application file for complete search history.

(56) References Cited

U.S. PATENT DOCUMENTS 8,127,837 B1 * 3/2012 Rose ..... E21B 33/02 405/52
9,175,550 B2 11/2015 Dunlavy
11,306,544 B2 * 4/2022 Al-Helal ..... E21B 33/037
2014/0102691 A1 * 4/2014 Gibson ..... E21B 33/03 166/244.1
2017/0241228 A9 8/2017 Dugas et al.
2018/0274301 A1 9/2018 Deul et al.

OTHER PUBLICATIONS

Fibergrate Composite Structures Inc., https://fibergrate.com/.
Fibergrate Inc., Fibergrate® Cellar Covers, 2011, Dallas, Texas, Cellar Grates Flyer.pdf (fibergrate.com).
ISCO, HDPE: High-Density Polyethylene, https://www.isco-ahmcelroy.com/wp-content/uploads/2019/03/HDPEPERTPPRCTVICbrochure.pdf, 2019.
Newpark, Cellars, 2016-2024 Newpark Resources Inc., https://www.newpark.com/cellars/.
Plastics Pipe Institute, Suggested Temperature Limits for the Operation and Installation of Plastic Piping in Non-Pressure Applications, TN-11, 2021, https://plasticpipe.org/common/Uploaded%20files/Technical/TN-11.pdf.

* cited by examiner

*Primary Examiner* — Matthew R Buck
(74) *Attorney, Agent, or Firm* — Bracewell LLP; Constance G. Rhebergen; Keith R. Derrington

(57) ABSTRACT

A well cellar assembly is made up of axially stacked segments that have closed contour structured sidewalls. The sidewalls include inner and outer layers, an annulus between the layers, and a girder in the annulus. The girder is an elongated tubular that helically circumscribes an axis of the assembly. Upper and lower ends of the segments are profiled complementary to opposing ends of adjacent segments, and straps secure adjacent segments to one another.

19 Claims, 7 Drawing Sheets

WELL CELLAR WITH CLOSED CONTOUR STRUCTURED WALL

BACKGROUND OF THE INVENTION

1. Field of Invention

The present disclosure relates to a well cellar made from tubular segments having structured wall construction.

2. Description of Prior Art

Hydrocarbon producing wellbores extend subsurface and intersect subterranean formations where hydrocarbons are trapped. Some type of hardware is typically mounted at the opening of each wellbore during drilling, and over the remaining life of the wellbore. During the time the wellbore is being drilled, the wellhead assembly usually is made up of a wellhead housing mounted over conductor pipe, and with a blow-out preventer ("BOP") mounted on an upper end of the wellhead housing. Also during one stage of drilling, conductor pipe is added which lines an upper portion of the wellbore. After drilling is complete, and prior to producing from the wellbore; the BOP is usually replaced with a production tree for controlling the flow of fluids produced from the wellbore.

A cellar is often formed around an opening of a wellbore, and that extends into the ground a few feet below the Earth's surface that provides the extra height between the rig floor and the wellhead, allowing for easier installation of control valves. Cellars often collect water, drilling mud, and fracking liquids that need to be pumped out. Dimensions of the cellar are typically 6 ft/1.8 m and are often cemented. In smaller rigs, the cellar also serves as the place where the lower part of the blowout preventers (BOP) stack resides. Wellhead cellars are sometimes used as a workspace for operations personnel to access valves and other fluids handling equipment associated with the wellhead assembly. Occasionally, cellars are also configured to capture and collect fluids leaking from wellhead equipment, or that has spilled around the wellhead. Without a cellar, the leaking/spilled fluids might otherwise contaminate the ground around the well. The types of leaking fluids that are collected generally include one or more of drilling fluid, oil, lubricants, or completion fluids. To ensure fluid is collected properly, a cellar is typically fabricated with sheet metal, fiberglass, or concrete. Cellar dimensions generally result in cellar liners having a size and mass that require mechanized equipment for their installation.

SUMMARY OF THE INVENTION

An example of a method of assembling a well cellar is disclosed, which includes obtaining annular segments having sidewalls; where the sidewalls are made of an annular inner layer, an annular outer layer circumscribing the inner layer, an annulus defined between the inner layer and outer layer, a girder helically arranged inside the annulus, and profiles on axial ends of the segments formed complementary to axial profiles on opposing ends of adjacent segments. The example method further includes stacking the segments inside an upper end of a wellbore, and securing adjacent segments together with straps. Slots are optionally formed radially through the inner layer and the outer layer, in an alternative, securing adjacent segments together with straps includes inserting the straps through the slots and tensioning the straps to exert a compressive force between the adjacent segments. In an example, the compressive force moves the axial ends of adjacent segments into close contact to form an interface between the axial ends that is a barrier to flow and the profiles on the axial end of the segments have a "V" shape. The straps are optionally tensioned with a ratcheting device that has a reel on which a portion of the strap is received, an elongated handle, and teeth coupled with a hub of the reel that selectively engage teeth coupled with the handle, so that when the handle is pivoted about the hub to rotate the reel, the strap is wound onto the reel. In an embodiment, the ratcheting device remains coupled to the strap during the life of the well cellar. In an alternative, the method includes manually lowering the segments into the wellbore. Lines are optionally attached to the slots for lowering the segments into the wellbore. Embodiments of the method include manually drawing the lines upward to remove the segments from the wellbore. In one example, the inner layer is formed by wrapping a sheet of thermoplastic over a mandrel in a helical pattern, fusing together lateral edges of the sheet that overlap with one another to form a tubular member. The girder is optionally added by wrapping an elongated tubular element over the tubular member. A cross section of the girder optionally is a rectangle or a circle.

An example of a well cellar assembly is disclosed that includes annular segments selectively stacked inside an upper end of a wellbore, where the segments have sidewalls that include an annular inner layer, an annular outer layer circumscribing the inner layer, an annulus defined between the inner layer and outer layer, slots formed radially through the inner layer and the outer layer, a girder helically arranged inside the annulus, and profiles on axial ends of the segments formed complementary to profiles on opposing axial ends of adjacent segments. The example well cellar assembly also includes straps extending through the slots that when selectively tensioned exert a securing force between adjacent segments. Optionally, the profile on an end of one of the segments protrudes axially away from the annulus, and where the profile on an end of an adjacent segment is a recess that extends axially into an annulus of the adjacent segment. Embodiments exist in which the profiles have a "V" shape. In alternatives, the segments are manually lowered into the wellbore, and the girder is an elongated tubular member. The assembly optionally also includes ratcheting assemblies for tensioning the straps, where the ratcheting assemblies are coupled with the straps during the life of the well assembly.

BRIEF DESCRIPTION OF DRAWINGS

Some of the features and benefits of the present invention having been stated, others will become apparent as the description proceeds when taken in conjunction with the accompanying drawings, in which.

Figure 1:
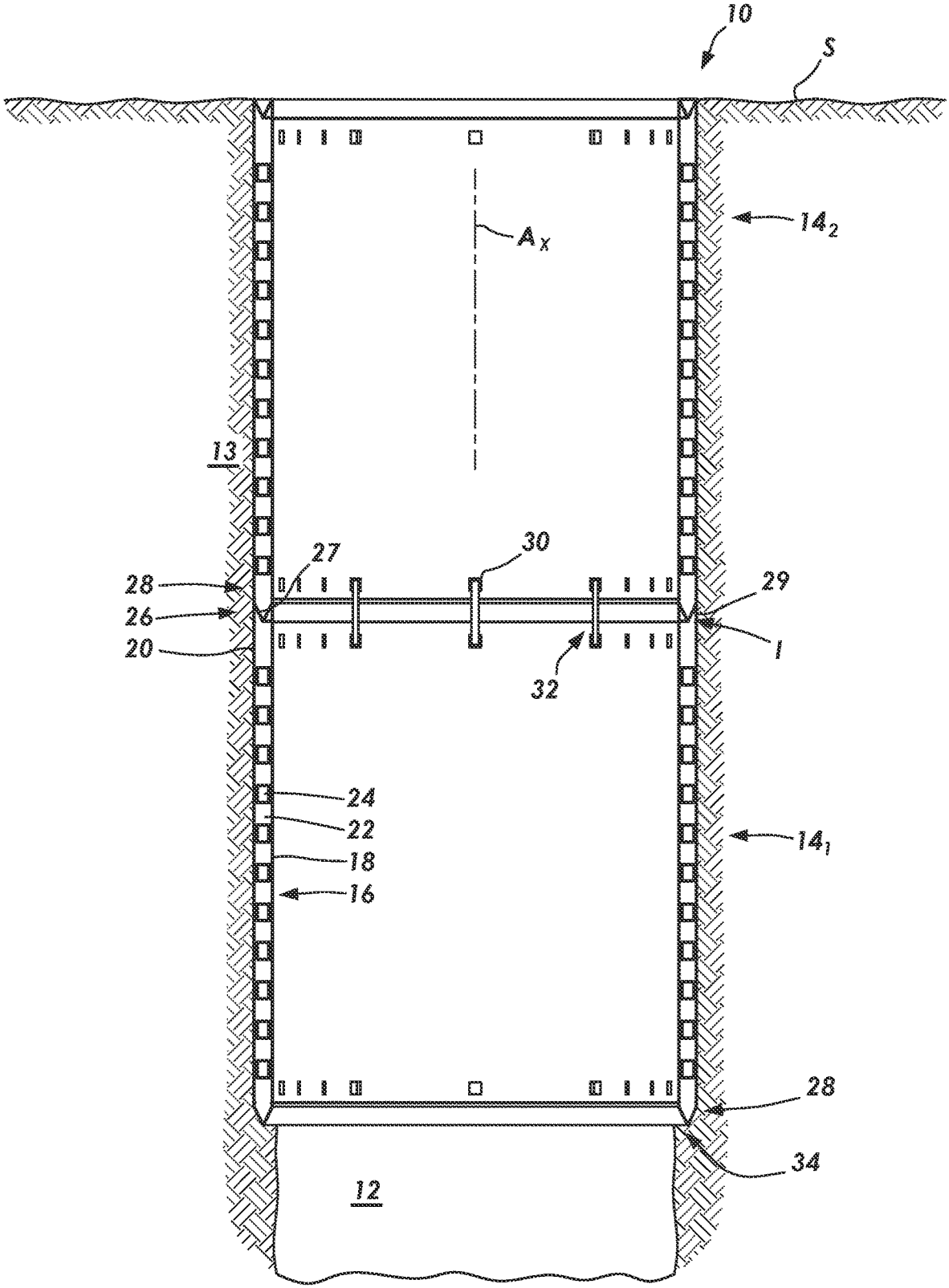
FIG. 1 is a side sectional view of an example of a well cellar assembly in accordance with the present disclosure.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Showing in a side sectional view in FIG. 1 is an example of a well cellar assembly 10 installed within an upper section of a wellbore 12. The well cellar assembly 10 of FIG. 1 has an outer surface shown in close contact with sidewalls of wellbore 12, and also with a subterranean structure 13 in which wellbore 12 is formed. Well cellar assembly 10 includes annular segments $\mathbf{14}_{1,2}$ shown stacked within wellbore 12. Sidewalls 16 of the segments $\mathbf{14}_{1,2}$ are made up of an inner layer 18 circumscribed by an outer layer 20 which defines an annulus 22 between the inner and outer layers 18, 20. A girder 24 is in the annulus 22, which in the example shown is a single tubular member arranged in a helical fashion within the annulus 22. Axial spacing between adjacent turns of the girder 24 is shown to be substantially uniform, options exist in which axial spacing varies. In an alternative, girder 22 is made up of multiple tubulars that each circumscribe the inner layer 18 and that are spaced axially apart from one another. Upper end 26 of segment $\mathbf{14}_1$ is shown having a profile 27, and lower end 28 of adjacent segment $\mathbf{14}_2$ is shown having a profile 29 complementary to profile 27, so that when segments $\mathbf{14}_{1,2}$ are stacked, profile 29 projects axially into profile 27.

Included with the illustrated example are slots 30 that project radially through sidewall 16 and are angularly spaced apart from one another about axis $A_X$. Optional straps 32 are shown extending through slots 30 for providing a securing force to maintain adjacent segments $\mathbf{14}_{1,2}$ joined to one another. Also shown in FIG. 1 is that an upwardly facing shoulder 34 is formed within wellbore 12 where a diameter of wellbore 12 is reduced. A lower end 28 of segment $\mathbf{14}_1$ is shown resting on the shoulder 34. An upper end 26 of segment $\mathbf{14}_2$ is shown terminating proximate where the wellbore 12 opening intersects with surface S of the earth. In alternatives, assembly 10 includes three or more segments 14, and optionally, an upper end of assembly 10 is above surface S.

Figure 2:
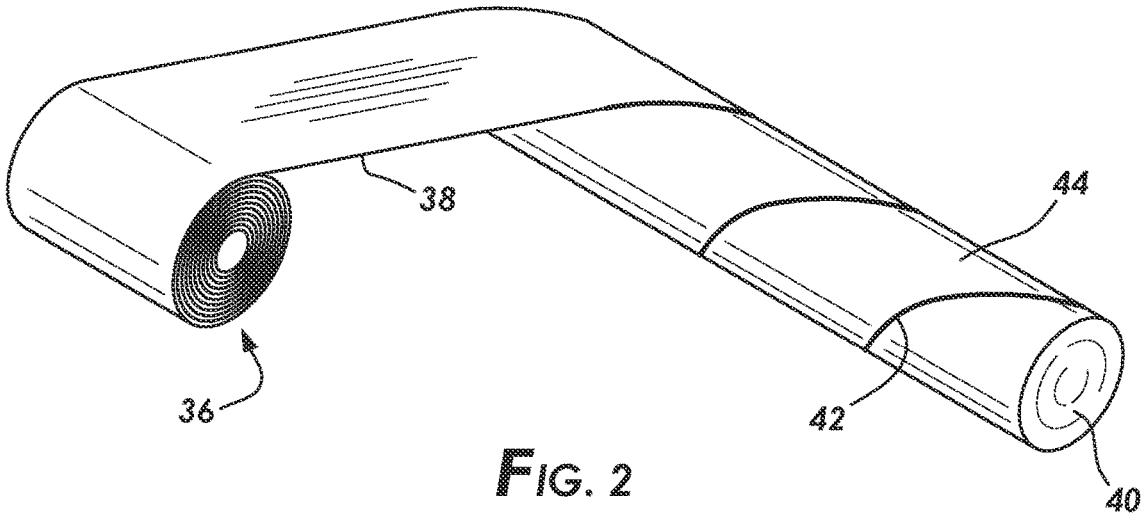
FIGS. 2 and 3 are perspective views of examples of steps of forming the well cellar assembly of FIG. 1.
Figure 3:
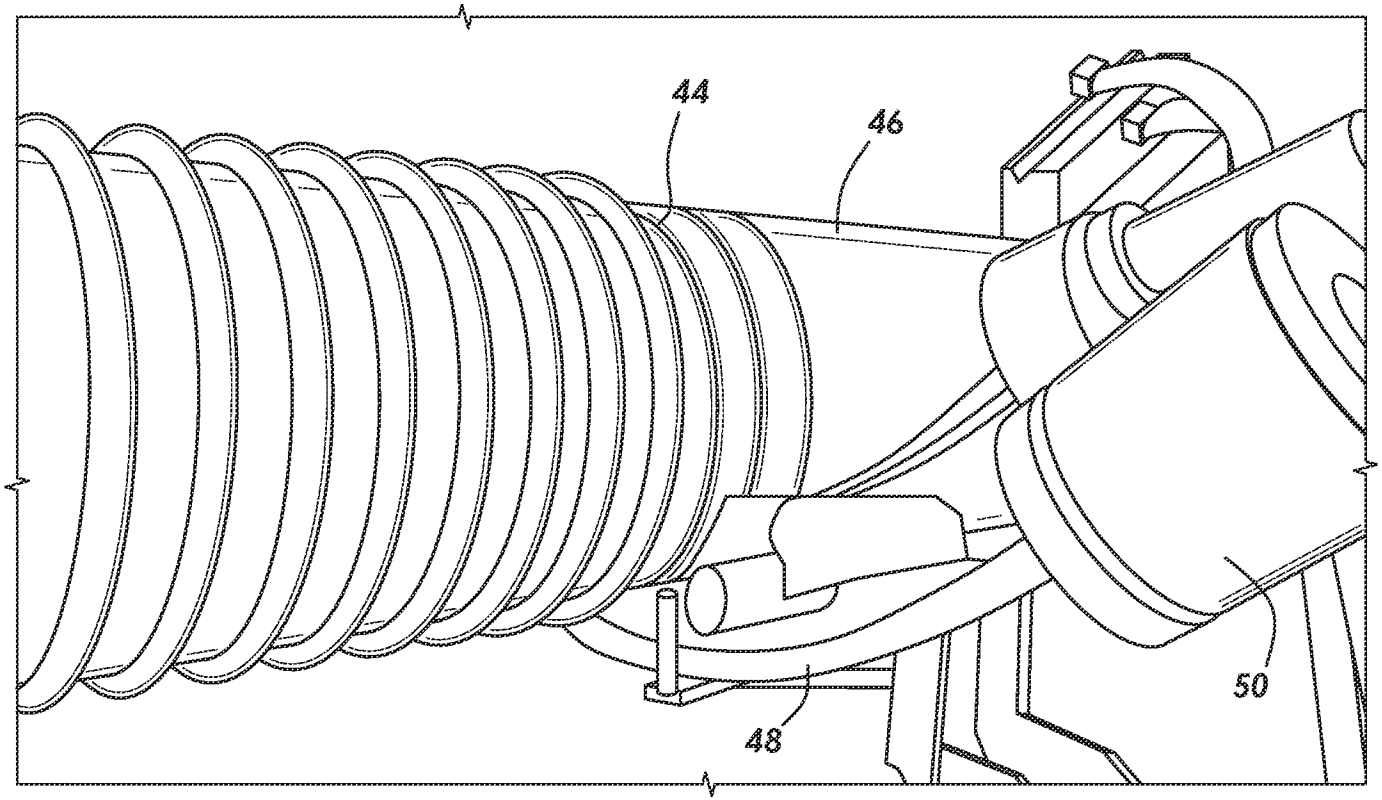

Referring now to FIGS. 2 and 3, shown in perspective view is an example process for forming segments $\mathbf{14}_{1,2}$. In FIG. 2 is a roll 36 having a long sheet of flexible material 38, which is shown being removed from the roll 36 and wrapped over an elongated cylindrical mandrel 40. The material 38 is laid over mandrel 40 in a helical pattern. In the example shown overlap of adjacent layers of the material 38 laid over mandrel 40 forms a seam 42, which also forms a helical pattern. Portions of material 38 that overlap to define the seam 42 are fused together, which forms a tubular member 44. In examples, the material 38 is a thermoplastic material and optional application of pressure and/or heat along seam 42 bonds layers of material 38 in the seam 42 to form the tubular member 44. In FIG. 3, tubular member 44 is shown on a mandrel 46, which in examples is the same as mandrel 40 of FIG. 2. While on mandrel 46, a length of tubing 48 is shown being wrapped around the tubular member 44 in a helical arrangement. In the example shown, tubing 48 has a diameter less than that of tubular member 44, and is delivered onto the tubular member 44 from a feeder 50.

In a subsequent step an outer tubular (not shown) is formed over the tubing 48 laid on the tubular member 44, in alternatives outer tubular is formed in a similar fashion as the tubular member 44. In examples of constructed segments $\mathbf{14}_{1,2}$, tubular member 44 forms the inner layer 18 (FIG. 1), the outer tubular forms the outer layer 20, and tubing 48 forms the girder 24. In alternatives the material making up one or more of layers 18, 20 and/or girder 24 includes a thermoplastic compound, such as polyethylene of raised temperature ("PE-RT") for layers 18 and 20 and polypropylene ("PP") for girder 24. In alternatives, the inner and outer layers 18, 20 are adhered to the girders 24 to form a closed contour structured wall constructed pipe. Examples of the material included in the closed contour structured wall constructed pipe include PE-RT, polyethylene resin of raised temperature and combinations. In a non-limiting example of use, a well cellar assembly 10 made of a PE-RT material has a design temperature of up to around 90° C.

Figure 4:
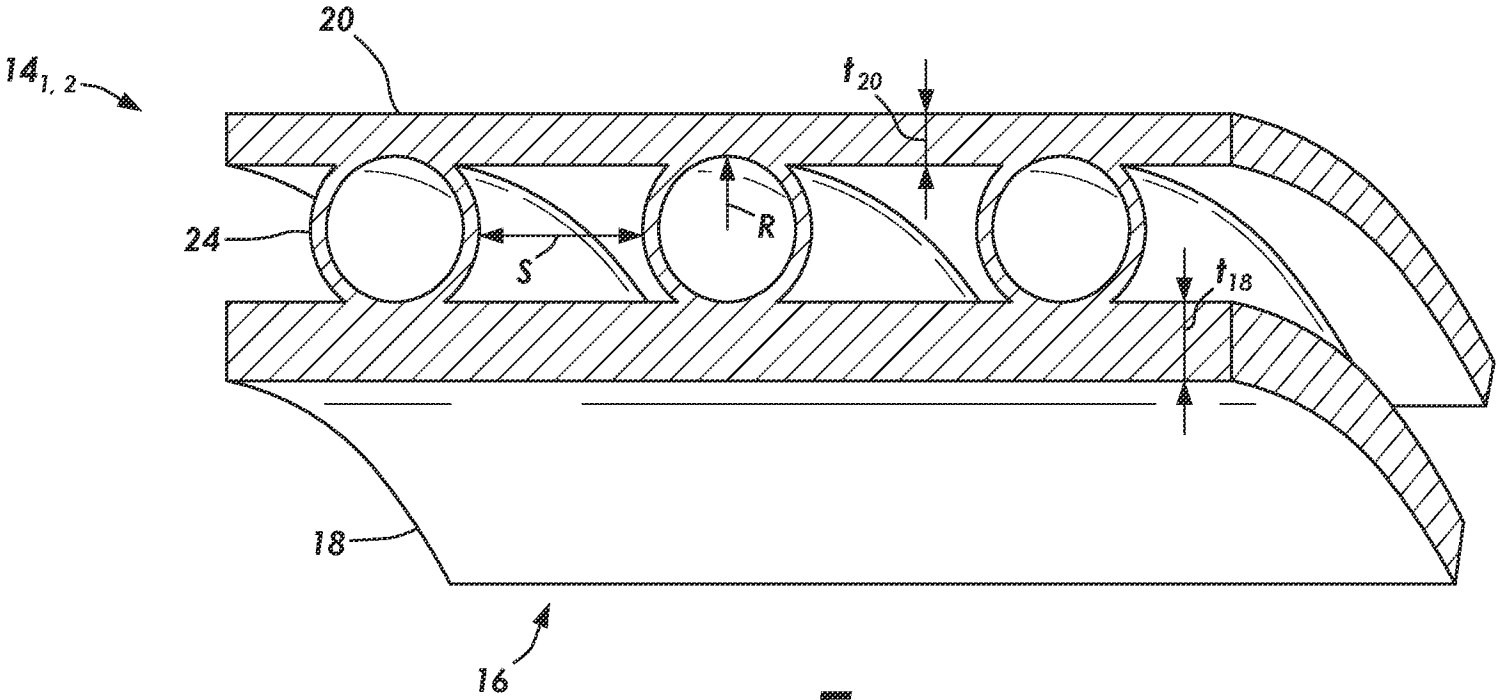
FIG. 4 is a sectional view of a portion of the well cellar assembly of FIG. 1.

Shown in sectional view in FIG. 4 is an example of a portion one of segments $\mathbf{14}_{1,2}$ with a closed contour structured wall construction. As shown, inner layer 18 is spaced away and radially inward from outer layer 20 to define annulus 22 between the layers 18, 20. In the annulus 22 are girders 24 having a circular cross section. The girders 24 in this example have a radius R and are spaced apart from one another by a space S. Values of radius R and space S are dependent upon the anticipated operating conditions of the well cellar assembly 10 (FIG. 1) and the material being used to create the segment $\mathbf{14}_{1,2}$. Also shown are thickness $t_{18}$ and thickness $t_{20}$ of the inner and outer layers 18, 20 respectively. Similar to the space S and radius R, values of thicknesses $t_{18}$, $t_{20}$ are dependent on anticipated operating conditions and materials used. Optionally, the cross section of girders 24 are rectangular as shown in FIG. 1.

Figure 5:
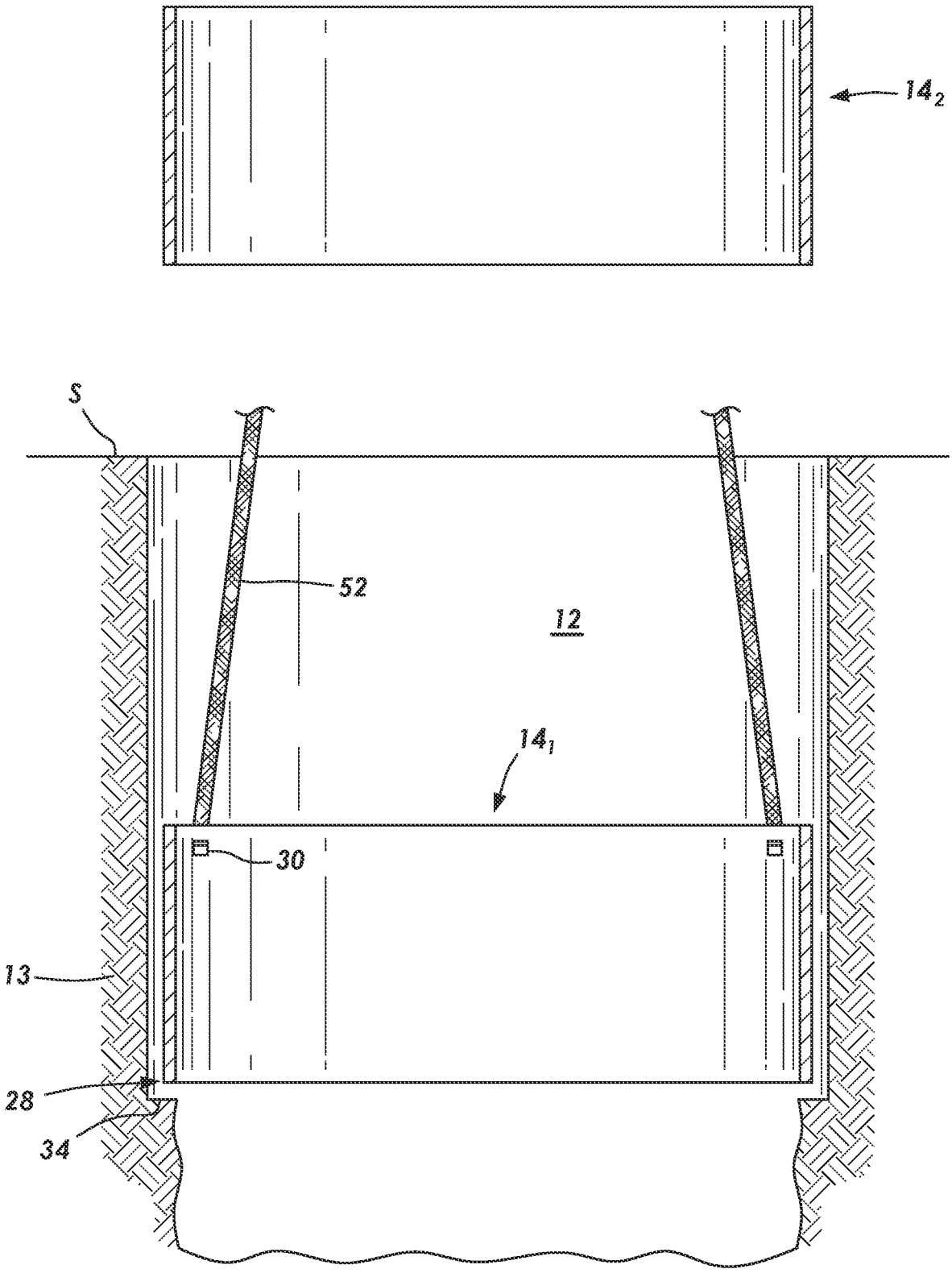

A non-limiting example of installing the well cellar assembly 10 in wellbore 12 is shown in a side sectional view in FIG. 5. In this example, lines 52 attach to and are used to lower segment $\mathbf{14}_1$ into the wellbore 12. Lines 52 are supported above surface S, and in examples are handled directly by personnel (not shown) on surface S; which allows for deploying the segments $\mathbf{14}_{1,2}$ in wellbore 12 without the need for cranes or other mechanized devices. In the example of FIG. 5, segment $\mathbf{14}_2$ is schematically illustrated spaced upwards from the wellbore 12 and in preparation for being lowered into wellbore 12 onto segment $\mathbf{14}_1$. In this example, lines 52 are removed from segment $\mathbf{14}_1$, or optionally an attachment is maintained so that when at a later date it is desired to remove the segments $\mathbf{14}_{1,2}$ from the wellbore 12, the lines 52 are drawn upwards to remove the segments $\mathbf{14}_{1,2}$ from the wellbore 12.

Figure 6:
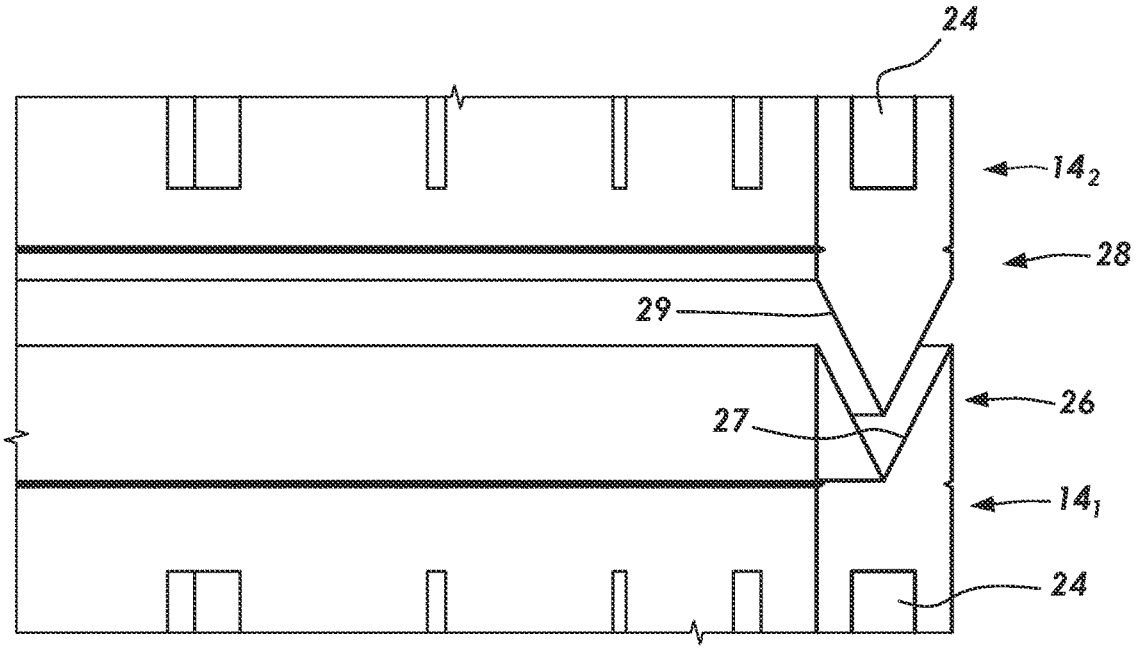
FIGS. 5 and 6 are side sectional views of an example of installing the well cellar assembly of FIG. 1 in a wellbore in accordance with the present disclosure.

Referring now to FIG. 6, shown is an example of segments $\mathbf{14}_{1,2}$ are being joined together, and illustrates in greater detail the profiles 27, 29 respectively formed on upper and lower ends 26, 28 of adjacent segments $\mathbf{14}_{1,2}$. In this example, profile 27 on the upper end 26 is a "V" shaped recess formed complementary to profile 29, which is a "V" shaped protrusion that extends axially from lower end 28 into profile 27 when segment $\mathbf{14}_2$ lands onto segment $\mathbf{14}_1$. An advantage of the complimentary shapes of the profiles 27, 29 is that lateral forces, that might otherwise misalign sidewalls 16 of the stacked segments $\mathbf{14}_{1,2}$, are resisted by interfering interaction created by inserting profile 29 into profile 27, which retains the segments $\mathbf{14}_{1,2}$ in engagement with one another in response to the shifting of the soil in the subterranean formation 13 (FIG. 1) that may occur during the life of the well.

Figure 7:
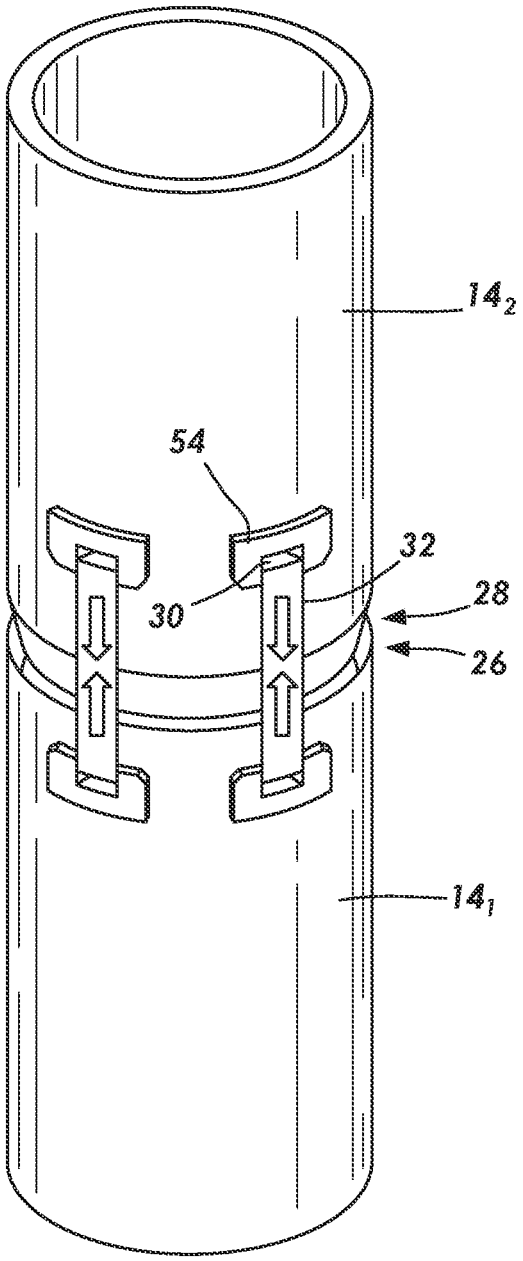
FIG. 7 is a side perspective view of an example of installing the well cellar assembly of FIG. 1 in a wellbore in accordance with the present disclosure.
Figure 8:
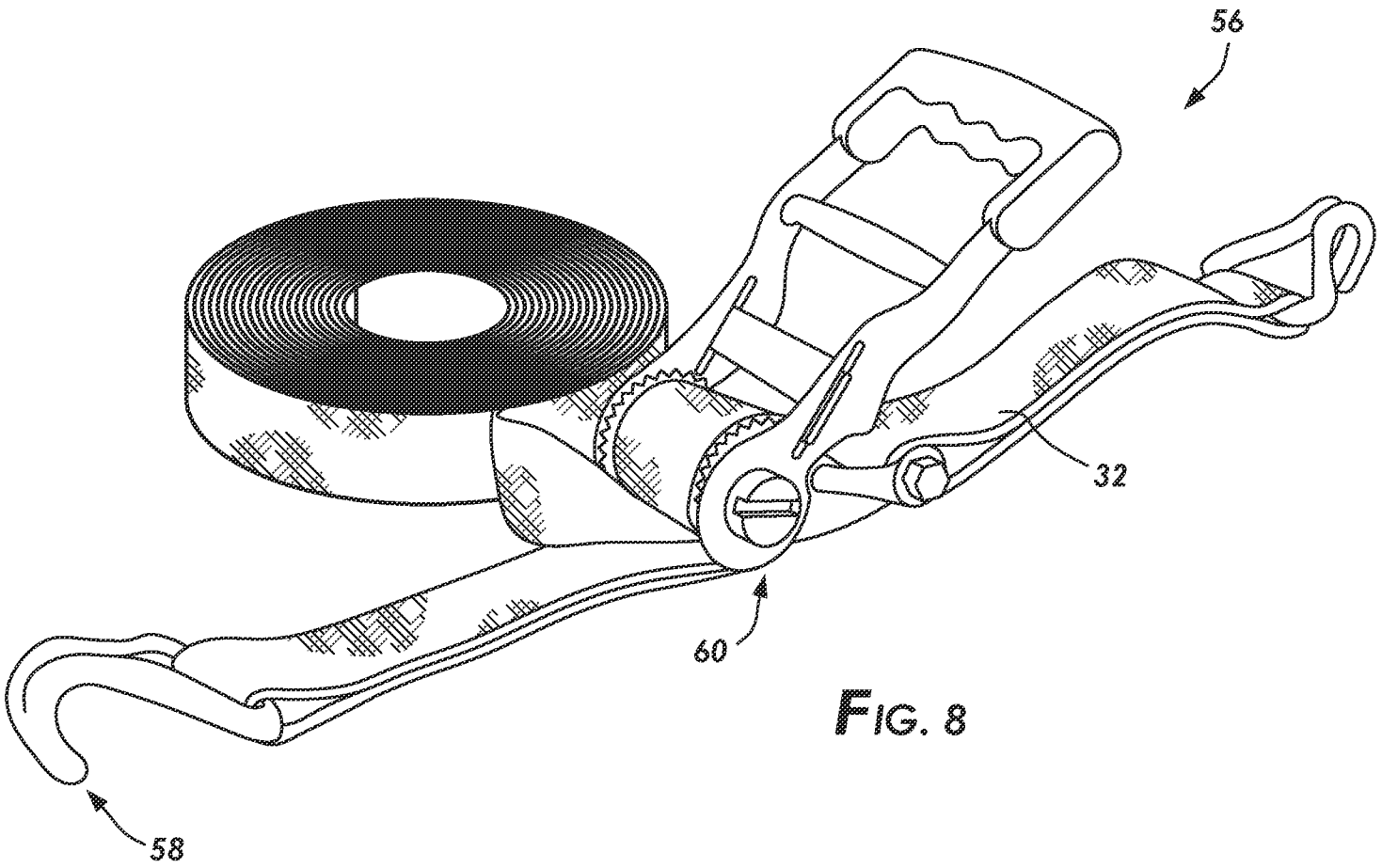
FIG. 8 is a perspective view of an example of a strap assembly for use in installing the well cellar assembly of FIG. 1.

Referring now to FIGS. 7 and 8, an example of using a strap for providing securing forces between the adjacent segments $\mathbf{14}_{1,2}$. In FIG. 7, the strap 32 is shown routed through the slots 30 formed radially through sidewalls 16 of the segments $\mathbf{14}_{1,2}$ and forces for drawing segments $\mathbf{14}_{1,2}$ together are illustrated with opposing arrows showing how tensioning of strap 32 exerts a compressional force to increase adherence between these two segments $\mathbf{14}_{1,2}$. Also shown in FIG. 7 is that each slot is circumscribed by a base 54 for facilitating inserting strap 32 into a respective slot 30. An example of the strap assembly 56 is shown in perspective view in FIG. 8 and in which included with strap 32 are hooks 58 on its opposing ends and a ratcheting device 60 for creating tension within strap 32 thereby bringing together the adjacent segments $\mathbf{14}_{1,2}$ as shown in FIG. 7. Ratcheting device 60 of FIG. 8 includes an elongated handle having a series of ratcheting teeth. An end of strap 32 attaches to a reel of device 60, which includes an inner hub with another series of teeth that selectively engage teeth on handle. In an example, the handle is pivoted, to rotate reel through interaction of the ratcheting teeth, which in turn draws strap onto reel and create tension in the strap 32. In examples, strap 32 and line 52 (FIG. 5) are made from a weave of fibers, such as but not limited to, cotton, polyester, thermoplastic, and combinations.

Advantages of using structured wall pipe for a well cellar assembly is that there be better use of the material at a lower cost. In an example, pipe stiffness ("PS") is calculated using Equation (1)

$$PS=f/\Delta y \qquad \text{Eqn. (1)}$$

Where:

F is load per unit length required to deflect the pipe to the deflection level in pounds per inch (lb/in.);

$\Delta y$ is pipe deflection in inches.

The flexural modulus (E) of the material and the stiffness of the geometric wall profile combine to form the wall stiffness. Geometry determines inertia of a piping product. The moment of inertia for a solid wall pipe is calculated as the cube of the wall thickness (t) divided by 12 (t3/12). To obtain the theoretical moment of inertia for the pipe wall cross section the contributions of each wall constituent for profile wall pipes is integrated.

Moment of inertia for the cross-section are optionally obtained by adding the contributions of each individual element as per following:

$$I_{X\text{-}X}=\Sigma(I_{X\text{-}X}+Ad^2) \qquad \text{Eqn. (2)}$$

In Equation 2 the overall moment of inertia (I) is calculated by summing the moment of inertia of each element about its own centroid plus the product of the element's cross-sectional area (A) and the square of the distance from the element's own centroid to the centroid of full cross section (d). Pipe stiffness correlates closely to the EI stiffness of a wall profile, for pipe sections made from the same material a profile wall that achieves the same moment of inertia as a solid wall pipe with less wall area provides a more efficient cross section and lower material costs for the producer. By adding the moment of inertia of each element around its own centroid, the product of the element's cross-sectional area (A), and the square of the distance from the element's own centroid to the centroid of the whole cross section, the formula's overall moment of inertia (I) is computed. A profile wall that achieves the same moment of inertia as a solid wall pipe with less wall area will provide a more efficient cross section and lower material costs for the selected application because pipe stiffness closely correlates to the EI stiffness of a wall profile. In an example, a square or rectangular profile is extruded and spirally wound onto a mandrel in a specially designed profile extrusion process to create PE-RT structured wall pipe. While still in the hot plastic state, the overlap on the edge of the extruded profile is homogenously fused together to produce a smooth internal surface. As a result, a light-weight PE-RT structured wall pipe is created, which has advantages over using high density polyethylene in that greater operating temperatures can be achieved.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of assembling a well cellar comprising:

obtaining annular segments having sidewalls comprising, an annular inner layer, an annular outer layer circumscribing the inner layer, an annulus defined between the inner layer and the outer layer, a girder helically arranged inside the annulus, and profiles on axial ends of the segments formed complementary to profiles on opposing axial ends of adjacent segments, and;

stacking the segments inside an upper end of a wellbore; and securing adjacent segments together with straps.

2. The method of claim 1, wherein slots are formed radially through the inner layer and the outer layer.

3. The method of claim 2, wherein securing adjacent segments together with straps comprises inserting the straps through the slots and tensioning the straps to exert a compressive force between the adjacent segments.

4. The method of claim 3, wherein the compressive force moves the axial ends of adjacent segments into close contact to form an interface between the axial ends that is a barrier to flow.

5. The method of claim 4, wherein the profiles on the axial end of the segments have a "V" shape.

6. The method of claim 3, wherein the straps are tensioned with a ratcheting device that comprises a reel on which a portion of the strap is received, an elongated handle, and teeth coupled with a hub of the reel that selectively engage teeth coupled with the handle, so that when the handle is pivoted about the hub to rotate the reel, the strap is wound onto the reel.

7. The method of claim 6, wherein the ratcheting device remains coupled to the strap during the life of the well cellar.

8. The method of claim 2, further comprising manually lowering the segments into the wellbore.

9. The method of claim 8, wherein lines are attached to the slots for lowering the segments into the wellbore.

10. The method of claim 9, further comprising manually drawing the lines upward to remove the segments from the wellbore.

11. The method of claim 1, further comprising forming the inner layer by wrapping a sheet of elastomer over a mandrel in a helical pattern, fusing together lateral edges of the sheet that overlap with one another to form a tubular member.

12. The method of claim 10, further comprising adding the girder by wrapping an elongated tubular element over the tubular member.

13. The method of claim 12, wherein a cross section of the girder comprises a shape selected from the group consisting of a rectangle and a circle.

14. A well cellar assembly comprising:

annular segments selectively stacked inside an upper end of a wellbore, the segments having sidewalls comprising, an annular inner layer, an annular outer layer circumscribing the inner layer, an annulus defined between the inner layer and the outer layer, slots formed radially through the inner layer and the outer layer, a girder helically arranged inside the annulus, and profiles on axial ends of the segments formed complementary to profiles on opposing axial ends of adjacent segments, and;

straps extending through the slots that when selectively tensioned exert a securing force between adjacent segments.

15. The assembly of claim 14, wherein the profile on an end of one of the segments protrudes axially away from the annulus and wherein the profile on an end of an adjacent segment is a recess that extends axially into an annulus of the adjacent segment.

16. The assembly of claim 15, wherein the profiles have a "V" shape.

17. The assembly of claim 14, wherein the segments are manually lowered into the wellbore.

18. The assembly of claim 14, wherein the girder comprises an elongated tubular member.

19. The assembly of claim 14, further comprising ratcheting assemblies for tensioning the straps, wherein the ratcheting assemblies are coupled with the straps during the life of the well assembly.

* * * * *